US006133819A

United States Patent [19]

Comberg et al.

[11] Patent Number: 6,133,819

[45] Date of Patent: Oct. 17, 2000

[54] LOAD-DEPENDENT PREVENTIVE FUSE

[75] Inventors: Albert Comberg; Rainer Waser, both of Aachen, Germany

[73] Assignee: U.S. Philips Corporation, New York, N.Y.

[21] Appl. No.: 08/843,790

[22] Filed: Apr. 21, 1997

Related U.S. Application Data

[63] Continuation of application No. 08/302,571, Sep. 8, 1994, abandoned.

[30] Foreign Application Priority Data

Sep. 9, 1993 [DE] Germany ..... 43 30 534

[51] Int. Cl.[7] ..... H01C 7/00

[52] U.S. Cl. ..... 338/13; 338/22 R; 338/20

[58] Field of Search ..... 361/8, 11; 338/13, 338/14, 20, 21, 22 SD; 337/163, 167, 300

[56] References Cited

U.S. PATENT DOCUMENTS

| | | | |
|---|---|---|---|
| 3,737,724 | 6/1973 | Salge et al. | 361/8 |
| 3,805,022 | 4/1974 | Kulwicki et al. | 219/505 |
| 3,878,501 | 4/1975 | Moorhead et al. | 338/22 R |
| 3,931,602 | 1/1976 | Jlasko | 337/163 |
| 3,976,854 | 8/1976 | Ishikawa et al. | 219/505 |
| 4,016,521 | 4/1977 | Seybold | 337/163 |
| 4,068,281 | 1/1978 | Harnden, Jr. | 361/106 |
| 4,770,833 | 9/1988 | Hughes | 264/120 |
| 5,379,022 | 1/1995 | Bacon et al. | 338/20 |

FOREIGN PATENT DOCUMENTS 0137044 3/1991 European Pat. Off. .

OTHER PUBLICATIONS

"DC Electrical Degradation of Perovskite–Type Titanate: II, Single Crystals" R. Waser, J. Am. Ceram, Soc. 73 (6) 1654–62 (1990).

*Primary Examiner*—Karl Easthom
*Attorney, Agent, or Firm*—Bernard Franzblau

[57] ABSTRACT

A load-dependent, preventive fuse with an electronic ceramic (12) in a housing (11) from which connection leads (14) are led outwards to detect at least a first type of load to which a device to be monitored is subjected, in which fuse use is made of a ceramic material, hereinafter referred to as TDR ceramic (12), whose electrically insulating state changes as a function of time, being the first type of load, and as a function of a second type of load, to a semiconducting state, and as a result thereof, when a dc voltage U is applied to the TDR ceramic (12) via connection leads (14) an increase in current forms the activation criterion for the fuse, which criterion is fulfilled under predeterminable conditions and determines a desired operating time τ.

19 Claims, 2 Drawing Sheets

LOAD-DEPENDENT PREVENTIVE FUSE

This is a continuation of application Ser. No. 08/302,571, filed Sep. 8, 1994, now abandoned.

BACKGROUND OF THE INVENTION

The present invention relates to a load-dependent preventive fuse.

Fuses for electric circuits are known per se. They are used to protect the electric circuits as well as the devices and machines connected thereto in case of undesired, generally unforeseen, loads on said circuits, which could cause damage to THE circuits as well as to the devices and machines connected thereto. Such loads may be caused by voltage peaks in the mains, short-circuits caused by improper use of the devices, ambient temperatures which are too high or too high a degree of humidity etc. Accordingly, fuses, thermistors or humistors are used, either separately or in combination with each other. Such fuses are hereinafter also referred to as load fuses.

To limit overvoltages in electric circuits use can be made of a varistor as disclosed in, for example, EP-B1-0137044, in which the electrical properties of a semiconducting strontium titanate ceramic are used. Electrical properties of different ceramic crystals are known from, for example, the paper by R. Waser, entitled "dc Electrical Degradation of Perovskite-Type Titanate: II, Single Crystals", published in J. Am. Ceram. Soc. 73 (6) 1654–62 (1990).

In quite a number of cases, however, it should never come to the point where a fuse becomes operative. The electrical device along with the electric circuit should rather be selectively switched off after a certain operating time or duration of the load, i.e. it is preventively switched off. This frequently occurs in situations where machines must be serviced for safety reasons after specific load intervals . Such machines include, for example, car or aircraft engines. The necessity of preventively switching off a device can also be prompted by the likelihood that in the near future the device will break down and that exchanging it while it is still functioning is simpler or cheaper than exchanging it when it is defective. In other devices, such as light sources, a specific property, for example the brightness, decreases with length of service in such a manner that the device should be exchanged, although other properties such as the electrical resistance are still satisfactory. Such fuses are hereinafter also referred to as preventive fuses.

Important components of such preventive fuses are elapsed time meters, mileage indicators or fluid-flow meters. In general, a meter reading is used to activate an optical or acoustic warning signal, so that the device can be switched off manually or by means of a control unit. Preventive fuses whose activation depends only on the elapsed time will hereinafter be referred to as time-dependent preventive fuses.

In many cases, however, preventive fuses whose activation is triggered by a combination or specific constellation of measured physical parameters are advantageous. In these cases, logically interconnected preventive fuses are used. Frequently, not only the operating time but also the accumulated load of a machine during its operating time should be used as a criterion for maintenance intervals. This applies, for example, to car engines. To determine the maintenance intervals, in general, monitoring only the mileage reading is insufficient. The temporally accumulated engine load must also be registered. It is conceivable that as a result of traffic jams the engine is operated over a prolonged period of time while the reading of the odometer remains unchanged.

The load to which engines are subjected is often directly proportional to the operating temperature of the engines. That is, the higher the temperature of the engine, the higher the load to which it is subjected. For this reason, preventive fuses which simultaneously monitor the operating time, the temporally accumulated operating temperature and hence the temporally accumulated operating load as the activation criterion are advantageous. This kind of preventive fuses will hereinafter also be referred to as load-controlled preventive fuses. According to the present state of the art, this problem is solved by preventive fuses which are provided with separate meters for temperature and time. However, each individual meter has a failure risk attached to it. Consequently, the failure risk of the assembled preventive fuse is higher than that of each individual element. In addition, the cost of mounting such an assembly is higher than that of mounting an individual element.

SUMMARY OF THE INVENTION

It is an object of the present invention to provide a load-dependent preventive fuse which, as a single component, can monitor a plurality of different types of loads, which is of a simple construction and, hence, the failure risk and mounting cost of which are minimized.

The preventive fuse in accordance with the invention comprises an electronic ceramic having electrodes, which is accommodated in a housing, and having connecting leads for the electrodes. The electronic ceramic in accordance with the invention, hereinafter also referred to as TDR (Time Dependent Resistor)-ceramic is a time-dependent resistor which shifts, as a function of time, from a quasi-insulating state to a semiconducting state, which constitutes the activation criterion. During operation of the preventive fuse in accordance with the invention, a dc voltage is to be applied to the TDR ceramic via the connecting leads, and the current increase at the end of the operating time is to be registered and evaluated.

At a constant temperature of the device to be monitored, the preventive fuse can come into action, in accordance with the invention, after a number of operating hours which can be predetermined.

Also, in accordance with the invention, the operating time $\tau$ of the TDR ceramic can be controlled in a defined manner both by the temperature T and the applied dc voltage U and the distance d of the electrodes on or in the TDR ceramic.

Surprisingly, it has been found that the following law applies:

$$\tau = A(U/U_0)^{n1}(d/d_0)^{n2}\exp\,(E_A/kT)$$

In this equation, the factor A, the exponents $n_1$ and $n_2$ as well as the activating energy $E_A$ are material-dependent constants. $U_0$ and do denote, respectively, the voltage unit and the unit of length. By varying the ceramic material, in particular the factor A can be changed by several orders of magnitude and can be accurately adjusted.

As follows from the above equation, the preventive fuse in accordance with the invention is also influenced by the temperature of the device to be monitored. Thus, in accordance with the invention, a very simple load-dependent preventive fuse is provided which is influenced both by the operating time and the temperature of a device to be monitored and which quasi automatically uses a combination of both measured values as the activation criterion.

It is also conceivable, however, that the temperature of the device to be monitored does not constitute a suitable activation criterion. In that case, the TDR ceramic is to be provided in a simple manner in accordance with the invention with an intrinsic heating element which may be formed by a positive temperature coefficient resistor, hereinafter referred to as a PTC element.

For the present invention any known electronic ceramic can be used whose electrical resistance exhibits a time-dependent behaviour when a dc voltage is applied. Such TDR ceramics are known, for example, from J. Am. Ceram. Soc. 73 (6) 1654–62(1990) and the literature cited therein. In the scope of the present invention it is preferred to use doped and non-doped alkaline earth titanates of the Perovskite type, such as $CaTiO_3$, $SrTiO_3$ or $BaTiO_3$. Doping can be effected by substituting 0.9–1.1 atm % alkali ions, such as sodium ions or potassium ions, for the alkaline earth ions. Another doping possibility, which may be used instead of or in combination with the first possibility, is doping of the titanate by acceptor ions, such as magnesium, aluminium, vanadium, chromium, manganese, iron, nickel or cobalt in a quantity of 0.1 to 3 atm %.

The TDR ceramic can be manufactured, for example, from strontium carbonate, titanium dioxide and nickel hydroxycarbonate, the composition being $SrTi_{1.01}N_{0.001}O_3$. The starting powders were first ground, calcinated at a temperature in the range from 950 to 1100° C., ground again, pressed and sintered in oxygen at 1480° C. for two hours. Subsequently, the TDR ceramic was cut into discs having a thickness up to several millimeters and both sides were provided with electrodes by applying a suitable metal paste by vacuum evaporation or firing. For the metals use can suitably be made of silver, gold, platinum, palladium or other noble metals or their alloys. In order to obtain a purely time-controlled preventive fuse, one side or both sides of this ceramic disc comprising electrodes can be brought into thermal contact with the PTC element made from $SrTi_{1.01}Ni_{0.001}O_3$. The PTC element may be composed of the known PTC ceramics. These include, for example, pure $BaTiO_3$ or solid solutions of $BaTiO_3$ with 0<atm % $PbTiO_3$<50 and/or 0<atm % $SrTiO_3$<50. The PTC element may be composed of, for example, 70 atm % $BaTiO_3$ and 30 atm % $PbTiO_3$, so that it has a Curie temperature Tc of approximately 260° C. Other PTC ceramics on a $BaTiO_3$ basis are doped with 0.1 to 0.3 atm % lanthanum, yttrium, bismuth, antimony, tantalum or niobium. The thermal contact can be established by a thin $Al_2O_3$ or AIN disc or by a thin mica plate to which the ceramic members are adhered by means of a temperature-resistant adhesive. The electrodes of the PTC element are also led out of the housing and, together with the other leads protruding from the housing, they can be led outwards, either electrically separated or, when the mica plate is omitted, with a common ground connection. In operation, the PTC element is heated to approximately the Curie temperature by applying a dc voltage. The resistance-temperature characteristic of the PTC element leads in known manner to a self-stabilization of the temperature. In accordance with the above equation, the operating time $\tau$ of the TDR ceramic now depends on the voltage.

As described above, without the PTC element, the fuse obtained is a time-dependent and temperature-dependent preventive fuse. The PTC element may be substituted, for example, by a metal bracket or the like. In that case, the operating time of this preventive fuse is not only governed by the voltage U and the thickness d but also by the integral temperature variation at the contact region of the device to be monitored.

In order to increase the operating time of the above-mentioned preventive fuse having a PTC element from the present value of several hours to several thousand hours, the TDR ceramic of $SrTi_{1.01}Ni_{0.001}O_3$ must be sintered at 1340° C. for six hours and, subsequently, be hot-pressed under argon at a pressure of 200 bar and a temperature of 1280° C., followed by a post-tempering treatment for eight hours at 800° C.

In addition, the operating time $\tau$ can be varied substantially by means of the sintering temperature by adding one mol % barium titanate silicate ($Ba_2Si_2TiO_8$) to the calcinated and ground starting powder.

Besides, the TDR ceramic may be constructed as a multilayer structure with an interspace d between the internal electrodes from several tens to 100 $\mu$m, enabling the fuse to be operated at extremely low voltages. In that case, the value of the exponent $n_2$ ranges between 1 and 1.1.

BRIEF DESCRIPTION OF THE DRAWINGS

The invention will be explained in greater detail by means of exemplary embodiments and with reference to the accompanying drawings, in which.

DETAILED DESCRIPTION OF THE PREFERRED EMBODIMENT

Figure 1:
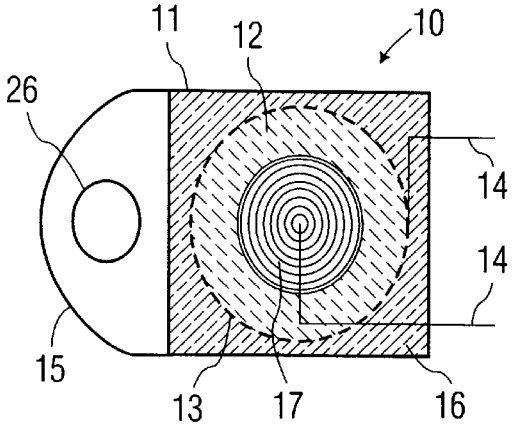
FIG. 1 is a top view of a preventive fuse in accordance with the invention.

FIG. 1 is a top view of a preventive fuse 10 in accordance with the invention. This preventive fuse 10 comprises a housing 11 which entirely encloses a TDR ceramic 12 and, optionally, a PTC element. Connection leads 14 leading to electrodes 17 of the TDR ceramic 12 or the PTC element 13 are led out of the housing 11. They lead to a voltage source and/or an evaluation unit. In order to enable the housing 11 to be mounted on a device to be monitored, it may be provided with a built-on on connection surface 15 having a through-hole 26, which surface may also be constructed so as to form an extension of the lower end plate of the housing 11. The housing 11 may be constructed from any desired material, however, preferably it is made from copper. This relates in particular to the connection surface 15. The housing 11 itself may be in the form of a cube or cuboid. Since the TDR ceramic 12 present inside the housing and the optionally present PTC element 13 are cylindrically shaped with a circular base, the remaining space in the housing 11 is filled with glass wool 16. FIG. 1 further shows an electrode 17 of the TDR ceramic 12.

Figure 2:
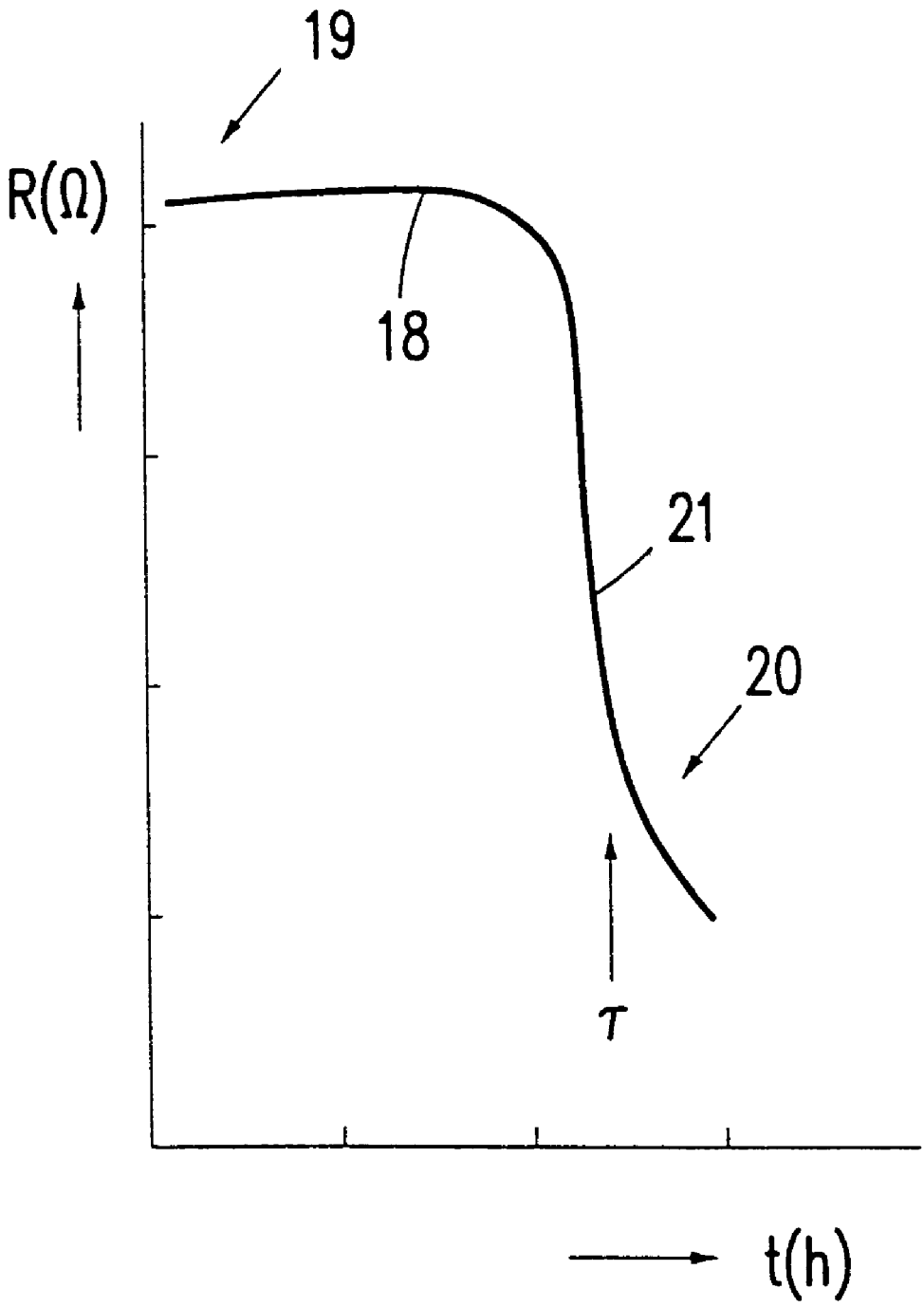
FIG. 2 shows the qualitative variation of the insulation resistance of an inventive TDR ceramic in time.

FIG. 2 shows how the insulation resistance R of the inventive TDR ceramic 12 varies with time $\tau$. The trend of the curve 18 shown for $SrTi_{1.01}Ni_{0.001}O_3$ corresponds approximately to the trend at a constant temperature T of 260° C., a voltage U of 80 V and a distance d of 0.5 mm, the insulation resistance 19 initially amounting to $10^8$ $\Omega$ but decreasing, after approximately two hours, to a value of approximately $10^5$ $\Omega$ at the area 20. This dependence, i.e. the fact that the operating time $\tau$ is controlled in a defined manner by the temperature, the applied voltage and the distance d between the electrodes 17 on or in the TDR ceramic surprisingly corresponds to the following, above-mentioned, empirical law:

$$\tau = A(U/U_0)^{n1}(d/d_0)^{n2}\exp(E_A/kT)$$

In this equation, the factor A, the exponents $n_1$ and $n_2$ as well as the activating energy $E_A$ are material-dependent constants. $U_0$ and $d_0$ denote, respectively, the voltage unit and the unit of length. A variation of the ceramic material enables, in particular, the factor A to be changed by several orders of magnitude and to be accurately adjusted, so that the descending portion 21 of the curve 18 in FIG. 2 can be shifted to the right or to the left on the time scale.

Figure 3:
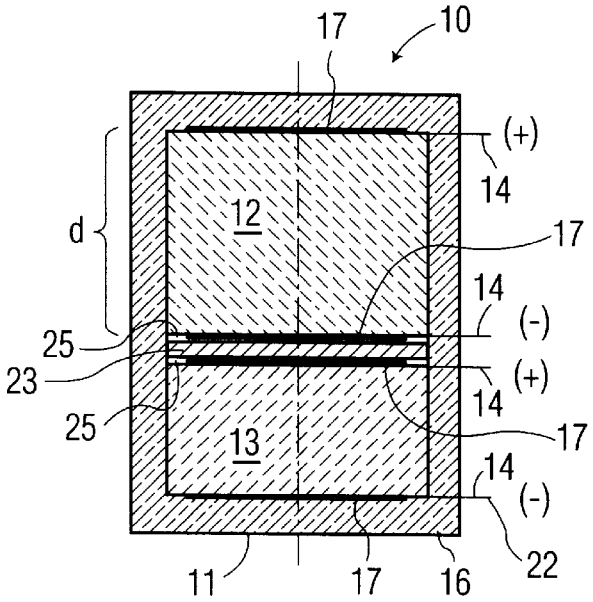
FIG. 3 is a sectional view of a preventive fuse in accordance with the invention having a PTC element and a separate ground connection.

FIG. 3 is a sectional view of a preventive fuse 10 in accordance with the invention, comprising a PTC element 13 and a ground connection 22 separated from the TDR ceramic 12 which is also shown. An insulating mica plate 23 is provided between the heating PTC element 13 and the TDR ceramic 12. The connection leads 14 lead to the electrodes 17 of the TDR ceramic 12 and the PTC element 13 and their order of polarization in FIG. 3, viewed from top to bottom, is +−+−. The space between the housing 11 and the PTC element 13 and the TDR ceramic 12 is filled up with glass wool 16. As stated above, instead of the PTC element 13, the bottom of the housing 11 may be provided with a connection surface 15, not shown in FIG. 3, which seals the housing 11 directly underneath the TDR ceramic 12 and thermally contacts the TDR ceramic.

Figure 4:
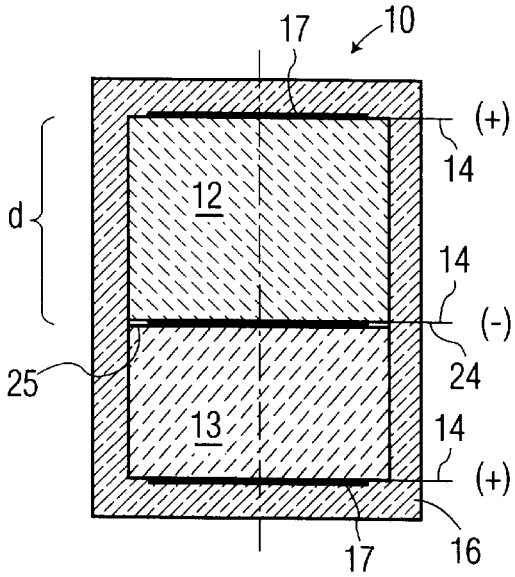
FIG. 4 is a sectional view of a preventive fuse in accordance with the invention having a PTC element and a common ground connection.

FIG. 4 is a sectional view of a preventive fuse 10 in accordance with the invention, comprising a PTC element 13 and a TDR ceramic 12 having a common ground connection 24 and hence only three connection leads 14 which are led outwards, so that the order of polarization is +−+. The preventive fuse 10 shown in FIG. 4 otherwise corresponds to the one described in FIG. 3. For the corresponding parts reference is made to the description of FIG. 3.

With respect to the TDR ceramic 12 it is noted that it may comprise a plurality of electrodes 17 and still be of a layered construction.

As regards the manufacture or compositions of the ceramic materials known per se from the above-mentioned prior art, the following elaboration is given. A preventive fuse 10 as shown in FIG. 3 is built up of an acceptor-doped alkaline earth metal titanate, for example Ni-doped, strontium titanate ceramic as the TDR ceramic 12 and a conventional PTC ceramic 13 on the basis of doped barium titanates or barium/lead titanates or barium/strontium titanates, which are thermally closely coupled but may be electrically insulated from each other.

The TDR ceramic 12 is manufactured from, for example, a mixture of strontium carbonate, titanium dioxide and nickel hydroxocarbonate, resulting in a ceramic material of the composition $SrTi_{1.01}Ni_{0.001}O_3$. The starting powders are ground at a temperature in the range from 950 to 1100° C., calcinated, ground again, pressed and sintered in a stream of oxygen for 2 hours at 1480° C. Subsequently, the TDR ceramic 12 is cut into discs having a thickness d (d ranging between 0.1 and 2 mm). The electrodes 17 are provided on both sides by applying a suitable metal paste by means of vacuum evaporation or firing. Metals which can suitably be used include silver, gold, platinum, palladium or other noble metals or alloys of said metals. One side or both sides of the ceramic disc comprising electrodes was brought into thermal contact with the PTC element 13 which consists of, for example, 70% $BaTiO_3$ and 30% $PbTiO_3$, resulting in a Curie temperature $T_C$ of approximately 260° C. The thermal contact can be established by a thin $Al_2O_3$ or AlN disc or mica plate 23 on which the ceramic elements 12, 13 are fixed by means of a temperature-resistant adhesive 25.

As shown in FIGS. 3 and 4, the electrical leads 14 can be led outwards, either electrically separated or, when the mica plate 23 is omitted, with a common ground connection 24. In operation, the PTC element 13 is heated approximately to Tc by applying a d.c. voltage. The resistance-temperature characteristic of the PTC element 13 leads in known manner to a self-stabilization of the temperature. The activation instant, i.e. the operating time τ of the TDR ceramic 12, depends, in accordance with the above equation, on the voltage U, the exponent $n_1$ for the TDR ceramic 12 used herein having a value of approximately −2. FIG. 2 shows the resistance of a ceramic disc 12 having a thickness d=0.5 mm and an electrode surface area of approximately 200 $mm^2$. At a temperature T=260° C., a desired operating time of the preventive fuse of τ=2 h at a voltage of 80 V is attained.

A preventive fuse which does not comprise a PTC heating element 13 is manufactured in the same manner as described above. Instead of the PTC ceramic 13 a connection bracket 15 is provided (see FIG. 1) which makes it possible to bring the fuse in close thermal contact with the device to be monitored.

The operating time of this fuse 10 does not only depend on the voltage U and the thickness d but also on the integral temperature variation in the contact region of the device to be monitored.

A preventive fuse, whether or not comprising a PTC heating element 13, can be manufactured in the same manner as described above. However, the sintering process can be varied so that the TDR ceramic 12 is sintered at 1340° C. for 6 hours. Subsequently, the ceramic 12 is hot-pressed in argon under a pressure of 200 bar at 1280° C. and post-tempered in oxygen at 800° C. for 8 hours.

As a result of a change in the microstructure of the ceramic 12 material, the operating time τ of this preventive fuse 10 is approximately 1000-times longer at unchanged parameters. At a thickness of the ceramic disc 12 of d=0.5 mm, a temperature T=200° C. and a voltage of 80 V, an operating time τ of the preventive fuse of 2000 hours is attained.

A preventive fuse 10, whether or not comprising a PTC element 13, can be manufactured as described above. A quantity of 1 mol % of barium titanate silicate ($Ba_2Si_2TiO_8$) can be added to the calcinated and ground starting powder. By virtue thereof, the operating time τ of the fuse 10 can be varied substantially with the aid of the sintering temperature. At a temperature of 360° C., a voltage of 125 V and a disc thicknesses of 1 mm, for example, a sintering process at 1340° C. for 6 hours results in an operating time τ=140 h, a sintering process at 1380° C. for 6 hours results in an operating time τ=28 hours and a sintering process at 1460° C. for 2 hours results in an operating time τ=11 h.

A preventive fuse 10, whether or not comprising a PTC element 13, can be manufactured as described above, and if the starting powder has been changed it can be manufactured as described in the preceding paragraph. The TDR ceramic 12 is constructed as a multilayer structure with a distance d in the range from 15 to 100 μm between the inner electrodes. This allows, in accordance with the above equation, the device to be operated at small voltages. The exponent $n_2$ is approximately 1.0 to 1.1.

The characteristic features of the invention, as disclosed in the above description, in the FIGS. 1, 2, 3 and 4 and in the claims, may either individually or in any combination be essential to the realisation of the various embodiments of the invention.

What is claimed is:

1. A load dependent preventive fuse and monitored device for monitoring a fixed period of time, comprising:

a ceramic time dependent resistor body having an electrical resistance that initially has a first high resistance value, the electrical resistance changing from the first high resistance value to a second lower resistance value dependent upon an accumulated period of time during which a DC voltage is applied across the ceramic body, the accumulated period of time depending upon the value of the DC voltage and the temperature of the ceramic body;

connection leads coupled to the ceramic body for applying a DC voltage across the ceramic body during said fixed period of time, means for sensing a change in resistance of the ceramic time dependent resistor body to the second lower resistance value, a housing which contains at least said ceramic time dependent resistor body; and a heating element in thermal contact with the ceramic time dependent resistor body whereby the heating element maintains the ceramic body at a constant temperature.

2. A preventive fuse as in claim 1 in combination with a monitored device wherein the ceramic body is in thermal contact with the monitored device.

3. A preventive fuse as in claim 2 wherein no voltage is applied across the ceramic time dependent resistor body when the monitored device is not operating.

4. A preventive fuse as in claim 1 wherein the heating element is a positive temperature coefficient resistor.

5. A preventive fuse as in claim 1 wherein the heating element is a resistor body comprising a material selected from the group consisting of barium titanates, lead titanates and strontium titanates.

6. A preventive fuse as in claim 1 wherein the ceramic body consists essentially of a doped ceramic oxide.

7. A preventive fuse as in claim 1 wherein the ceramic body consists essentially of one or more doped or undoped alkaline earth titanates.

8. A preventive fuse as in claim 1 wherein the ceramic body comprises an alkaline earth titanate.

9. A preventive fuse as in claim 8 wherein the alkaline earth titanate is selected from the group consisting of $CaTiO_3$, $SrTiO_3$ and $BaTiO_3$.

10. A preventive fuse as in claim 8 wherein the alkaline earth titanate is doped.

11. A preventive fuse as in claim 1 wherein the ceramic body consists essentially of a doped or undoped Perovskite.

12. A preventive fuse as in claim 1 wherein the ceramic body comprises a Ni-doped strontium titanate ceramic.

13. A preventive fuse as in claim 12 wherein the Ni-doped strontium titanate ceramic has the composition $SrTi_{1.01}Ni_{0.001}O_3$.

14. A preventive fuse for monitoring operation of a monitored device and which is activated after a fixed period of time, comprising:

a ceramic time dependent resistor body having an electrical resistance that changes from an initial resistance value to a second different resistance value in dependence upon an accumulated period of time during which a voltage is applied across the time dependent resistor body, connection leads coupled to opposite sides of the time dependent resistor body for applying a voltage across the time dependent resistor body and during operation of the monitored device for said fixed time period, means for sensing a change in resistance of the ceramic time dependent resistor body to the second resistance value activating same and indicating expiration of said fixed time period and thereby the operating time for the monitored device; and, a heating element wherein the change in the electrical resistance of the ceramic time dependent resistor body also depends upon temperature of the ceramic time dependent resistor body, and the ceramic time dependent resistor body is in thermal contact with said heating element which maintains the ceramic time dependent resistor body at a constant temperature.

15. A preventive fuse as in claim 14 wherein no voltage is applied across the ceramic time dependent resistor body when the monitored device is not operating.

16. A preventive fuse as in claim 14 wherein the change in the electrical resistance of the time dependent resistor body also depend upon temperature of the time dependent resistor body, and the time dependent resistor body is adapted for thermal contact with the monitored device.

17. A preventive fuse as in claim 14 wherein the change in the electrical resistance of the ceramic time dependent resistor body also depends upon the value of the voltage applied across the ceramic time dependent resistor body.

18. A preventive fuse as in claim 17 wherein the voltage applied across the ceramic time dependent resistor body by said connection leads is substantially constant.

19. A method of protecting a device with a preventive fuse, said fuse comprising a housing, a time dependent resistor ceramic in said housing, receiving means coupled to said ceramic, for receiving a dc voltage thereacross and for allowing a current to flow through said ceramic, said ceramic being operational for a predeterminable period of time is a first state, after said predeterminable period of time said ceramic being changeable to a second state, said ceramic having a characteristic such that said predeterminable period of time during which said ceramic is in said first state is a function of a duration of time during which said dc voltage is placed across said ceramic and the influence of a second measurable load on said ceramic, said second measurable load being variable independently of said duration of time, and means for measuring said second measurable load on said ceramic, said method comprising the steps of:

coupling said ceramic to said device;

measuring the time the dc voltage is placed across said ceramic and measuring the influence of said second load on said ceramic; and measuring the change in current flow through said ceramic when said ceramic changes from said first state to said second state.

* * * * *